United States Patent [19]

Baranov

[11] 4,170,887

[45] Oct. 16, 1979

[54] INDUCTOR FOR WORKING METALS BY PRESSURE OF PULSATING MAGNETIC FIELD

[75] Inventor: Mikhail I. Baranov, Kharkov, U.S.S.R.

[73] Assignee: Kharkovsky Politekhnichesky Institut, Kharkov, U.S.S.R.

[21] Appl. No.: 823,421

[22] Filed: Aug. 10, 1977

[51] Int. Cl.[2] ..... B21D 26/19

[52] U.S. Cl. ..... 72/56; 29/421 M; 72/DIG. 26; 72/DIG. 30; 219/7.5; 336/223

[58] Field of Search ..... 219/149, 152, 7.5; 72/56, DIG. 30, DIG. 26; 29/421 M; 336/178, 221, 223

[56] References Cited

U.S. PATENT DOCUMENTS

| | | | |
|---|---|---|---|
| 3,823,589 | 7/1974 | Tikhonovich et al. | 336/178 X |
| 3,921,426 | 11/1975 | Bely et al. | 72/56 |
| 4,067,216 | 1/1978 | Khimenko et al. | 29/421 M |

FOREIGN PATENT DOCUMENTS 1283786 11/1968 Fed. Rep. of Germany .

*Primary Examiner*—Thomas J. Kozma
*Attorney, Agent, or Firm*—Fleit & Jacobson

[57] ABSTRACT

Disclosure is made of an inductor for working metals by the pressure of a pulsating magnetic field, which comprises a magnetic field concentrator with an insulating slot. The concentrator has a cylindrical surface, whereon there is arranged a winding which induces eddy currents in the concentrator, and a surface, whereon there are concentrated eddy currents which induce eddy currents in the workpiece. The concentrator is provided with a conducting compensation rod overlapping the insulating slot, which rod is insulated from the concentrator and received in an opening extending along the slot in immediate proximity to that surface of the concentrator where there are induced eddy currents which induce eddy currents in the workpiece. The proposed inductor design makes it possible to produce a uniform magnetic field which, in turn, produces electrodynamic forces that work a blank so as to improve the quality of products, as compared to conventional working techniques.

3 Claims, 5 Drawing Figures

INDUCTOR FOR WORKING METALS BY PRESSURE OF PULSATING MAGNETIC FIELD

The present invention relates to metal working devices and, more particularly, to inductors for working metals by the pressure of a pulsating magnetic field.

The invention is applicable to working tubular and flat metal articles and is advantageous for such operations as squeezing, spreading, pressing, welding, and stamping of flat articles.

There is known an inductor for working metals by the pressure of a pulsating magnetic field (cf. West German Pat. No. 1,283,786, Cl. 7c 26/14, of Aug. 11, 1965), comprising a magnetic field concentrator with an insulating slot, which concentrator has a cylindrical surface, whereon there is arranged a winding inducing eddy currents in the concentrator. The concentrator is a thick-walled cylinder provided with an axial bore to receive a workpiece.

On the surface of said bore there are concentrated eddy currents which induce eddy currents in the workpiece. The interaction of these currents produces electrodynamic forces which work the blank.

However, the presence of the insulating slot accounts for a non-uniform distribution of the magnetic field in the gap between the concentrator and the workpiece, which, in turn, accounts for a non-uniform electromagnetic pressure on the surface of the workpiece which is being worked, and a subsequent formation of a bead of metal opposite the insulating slot. As a result, the workpiece is deformed to a lesser extent in the area opposite the insulating slot of the concentrator, which affects the quality of the product.

It is an object of the present invention to improve the working of articles by improving the uniformity of the magnetic field produced by the concentrator.

The foregoing object is attained by providing an inductor for working metals by the pressure of a pulsating magnetic field, comprising a magnetic field concentrator with an insulating slot, which concentrator has a cylindrical surface, whereon there is arranged a winding inducing eddy currents in the concentrator, and a surface, whereon there are induced eddy currents which induce eddy currents in a workpiece, which concentrator further includes, in accordance with the invention, a conducting compensation rod overlapping the insulating slot, which rod is received in an opening extending along the slot close to the surface of the concentrator, whereon there are concentrated eddy currents inducing eddy currents in the workpiece, the compensation rod being electrically insulated from the concentrator.

The proposed inductor design makes it possible to compensate the non-uniformity of the magnetic field due to the presence of the insulating slot, and thus raise the quality of products.

Other objects and advantages of the present invention will be better understood from the following detailed description of preferred embodiments thereof to be read in conjunction with the accompanying drawings, wherein.

Figure 1:
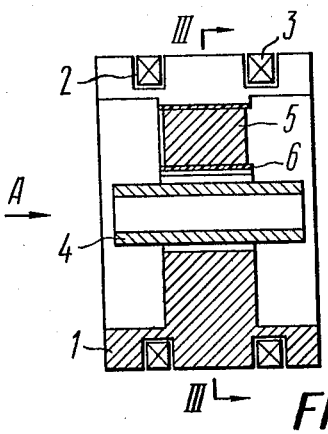
FIG. 1 is a general elevation view in section of an inductor for squeezing metal pipes, in accordance with the invention.

The proposed inductor for working metals by using the pressure of a pulsating magnetic field comprises a cylindrical magnetic field concentrator 1 (FIG. 1), on whose outer surface there are provided grooves 2 to receive a winding 3 which induces eddy currents in the concentrator 1.

Figure 2:
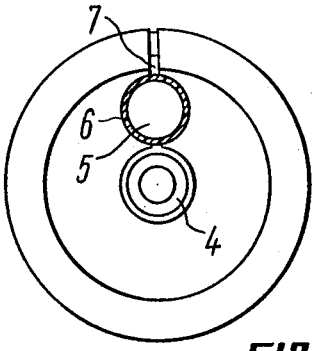
FIG. 2 is a view of the inductor of FIG. 1, taken in the direction of the arrow A and explaining the positioning of the compensation rod, in accordance with the invention.

The concentrator 1 has an axial bore to receive a workpiece 4. Close to said axial bore there is an opening to receive a conducting compensation rod 5. The rod 5 is separated from the concentrator 1 and the workpiece 4 by an insulating insert 6 which serves to insulate the rod 5 from the concentrator 1. The concentrator 1 has an insulating slot 7 (FIG. 2) overlapped by the rod 5.

Figure 3:
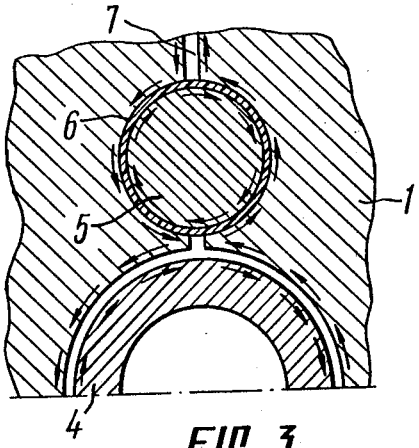
FIG. 3 is a sectional view of the concentrator, taken on line III—III of FIG. 1, at the location of the compensation rod, which explains the flow of currents through the concentrator, compensation rod and workpiece, as well as the interaction of these currents, in accordance with the invention.

The inductor under review is used for squeezing metal pipes. The workpiece 4 is placed in the axial bore of the concentrator 1. Pulse current is passed through the winding 3 and induces eddy currents in the walls of the grooves 2. The eddy currents are shorted through the surfaces of the insulating slot 7 and the opening which receives the compensation rod 5, and are concentrated on the surface of the axial bore accommodating the workpiece 4 (FIG. 3). The flow of currents is shown by arrows in FIG. 3. The magnetic field, produced by the currents which flow past the axial opening, induces currents in the workpiece 4. The current, which flows past the opening accommodating the compensation rod 5, induces eddy currents in said rod 5. The direction of these eddy currents in the zone of the insulating slot 7 and the workpiece 4 coincides with the direction of current in the axial opening. As a result, an additional magnetic flux, produced by the current through the compensation rod 5, acts on the workpiece 4 in the zone of the insulating slot 7. The induction of the magnetic field in the gap between the concentrator 1 and the workpiece 4, about the latter's circumference, becomes more uniform, which, in turn, accounts for a more uniform electromagnetic pressure on the workpiece 4 along the circumference of the axial opening, and improves the accuracy of working the article 4.

Figure 4:
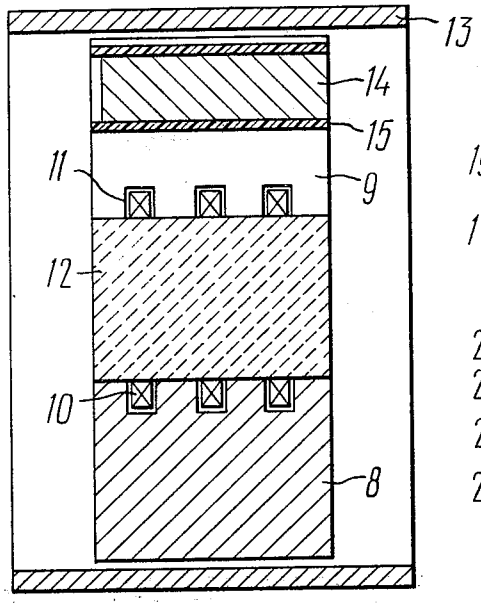
FIG. 4 is an elevation view of another preferred embodiment of the proposed inductor, intended for spreading of tubular metal articles.

The proposed inductor for spreading tubular metal articles comprises a cylindrical magnetic field concentrator 8 (FIG. 4) with an insulating slot 9.

A winding 10, which induces eddy currents in the concentrator 8, is received in grooves 11 provided on the surface of the axial bore of the concentrator 8, which is plugged by a bush 12 of an insulating material. In order to spread a tubular metal article 13, the inductor is placed inside it. Eddy currents, which induce eddy currents in the article 13, are concentrated on the external surface of the concentrator 8. Close to this surface, there is provided an opening which extends along the insulating slot 9 and receives a conducting compensation rod 14 which overlaps the insulating slot 9. The rod 14 is insulated from the concentrator 8 by an insulating bush 15. The inductor operates as the one described above.

Figure 5:
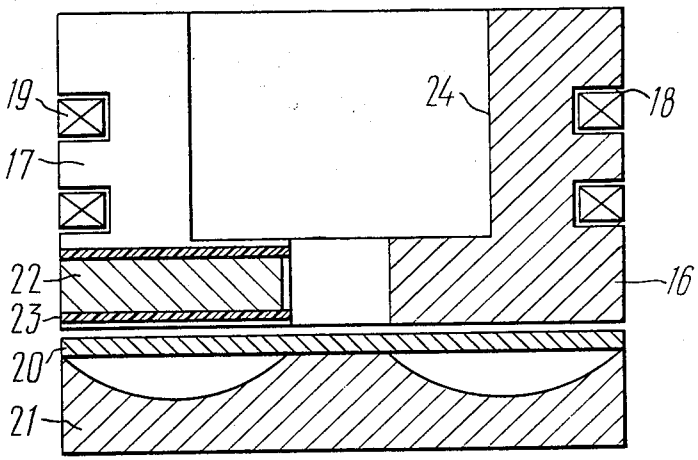
FIG. 5 is an elevation view of a third embodiment of the proposed inductor, intended for working of flat metal articles.

The proposed inductor for working flat metal articles comprises a cylindrical magnetic field concentrator 16 (FIG. 5) with an insulating slot 17. On the external cylindrical surface of the concentrator 16 there are provided grooves 18 which receive a winding 19 inducing eddy currents in the concentrator 16. The eddy currents are concentrated on the end face of the concentrator 16 and induce eddy currents in a workpiece 20 placed on a female die 21.

The concentrator 16 has an opening arranged close and parallel to its end face. The opening extends along the insulating slot 17 and receives a conducting compensation rod 22 which overlaps the insulating slot 17. The rod 22 is insulated from the concentrator 16 by an insulating bush 23. The concentrator 16 also has a stepped axial bore 24.

The inductor for working flat metal articles operates as follows. First, the flat article 20 to be worked is placed on the female die 21. The inductor is brought to the article 20.

Pulse current is passed through the winding 19 and induces eddy currents in the walls of the grooves 18 of the concentrator 16. By selecting the diameters of the axial bore 24, a greater part of the eddy currents of the grooves 18 is made to flow through the slot 17 past the opening which accommodates the compensation rod 22; these currents are shorted against the flat end face surface of the concentrator 16, on whose side the flat article 20 is molded in the female die 21. In all other respects, the inductor for working flat metal articles operates like those for squeezing and spreading tubular metal articles. Upon finishing the working of the flat metal article 20, the concentrator 16 and other components of the inductor are brought away from the flat article 20, and the latter is removed from the female die 21.

What is claimed is:

1. An inductor for working metals by the pressure of a pulsating magnetic field, comprising:

a magnetic field concentrator having a cylindrical surface;

an insulating slot provided in said concentrator;

a winding arranged on said cylindrical surface of said concentrator and inducing eddy currents in said concentrator;

said concentrator having a surface upon which are concentrated said eddy currents for inducing eddy currents in metal being worked;

an opening wider than said insulating slot provided in said concentrator and extending axially along said insulating slot, close to said surface of said concentrator upon which are concentrated said eddy currents which induce eddy currents in the metal being worked;

a conducting compensation rod overlapping said insulating slot and accommodated in said opening; and means for insulating said conducting compensation rod from said magnetic field concentrator.

2. An inductor as recited in claim 1 wherein said surface upon which are concentrated said eddy currents is an interior surface of said inductor.

3. An inductor as recited in claim 1 wherein said surface upon which are concentrated said eddy currents is an exterior surface of said inductor, said metal being worked being a tubular material surrounding said inductor.

* * * * *